US005722846A

United States Patent [19]

Lazaro, Jr.

[11] Patent Number: 5,722,846

[45] Date of Patent: *Mar. 3, 1998

[54] BAYONET COUPLING, LOW IMPEDANCE, VIBRATION RESISTANT CABLE CLAMP

[75] Inventor: Luis J. Lazaro, Jr., Seattle, Wash.

[73] Assignee: The Boeing Company, Seattle, Wash.

[ * ] Notice: The term of this patent shall not extend beyond the expiration date of Pat. No. 5,458,501.

[21] Appl. No.: 743,101

[22] Filed: Nov. 4, 1996

Related U.S. Application Data

[63] Continuation of Ser. No. 503,762, Jul. 13, 1995, abandoned, which is a continuation of Ser. No. 48,702, Apr. 15, 1993, Pat. No. 5,458,501, which is a continuation-in-part of Ser. No. 972,655, Nov. 6, 1992, abandoned, which is a continuation-in-part of Ser. No. 901,468, Jun. 19, 1992, abandoned, which is a continuation-in-part of Ser. No. 827,118, Jan. 28, 1992, abandoned, which is a continuation-in-part of Ser. No. 660,313, Feb. 22, 1991, abandoned, which is a continuation-in-part of Ser. No. 516,403, Apr. 30, 1990, abandoned.

[51] Int. Cl.[6] ..... H01R 4/54

[52] U.S. Cl. ..... 439/318

[58] Field of Search ..... 439/314, 315, 439/318–321, 460, 464, 470–473, 609, 610, 905

[56] References Cited

U.S. PATENT DOCUMENTS

| | | | |
|---|---|---|---|
| 1,271,039 | 7/1918 | Kiehler . | |
| 2,222,723 | 11/1940 | Richardson | 172/326 |
| 2,984,811 | 5/1961 | Hennessey, Jr. et al. . | |
| 3,055,071 | 9/1962 | Dzus et al. | 24/221 |
| 3,099,056 | 7/1963 | Hurcomb | 24/84 |
| 3,154,360 | 10/1964 | Plishner . | |
| 3,551,880 | 12/1970 | Hartwell . | |
| 3,750,087 | 7/1973 | Vetter . | |
| 3,876,199 | 4/1975 | Eichenauer | 272/62 |
| 3,902,817 | 9/1975 | Meir | 403/188 |
| 4,358,176 | 11/1982 | Arnold et al. . | |
| 4,509,814 | 4/1985 | Mattingly, Jr. . | |
| 4,534,607 | 8/1985 | Tomsa . | |
| 4,550,967 | 11/1985 | Riches et al. . | |
| 4,900,260 | 2/1990 | Drogo | 439/321 |
| 5,205,547 | 4/1993 | Mattingly | 267/158 |
| 5,458,501 | 10/1995 | Lazaro, Jr. et al. | 439/472 |

FOREIGN PATENT DOCUMENTS

| | | |
|---|---|---|
| 2002273 | 2/1969 | France . |
| 2533273 | 3/1984 | France . |
| 203358 | 9/1923 | United Kingdom . |
| 2045010 | 10/1980 | United Kingdom . |

*Primary Examiner*—Khiem Nguyen
*Attorney, Agent, or Firm*—Conrad O. Gardner

[57] ABSTRACT

A cable clamp which utilizes a bayonet coupling attachment mechanism when coupled into an electrical connector. Helical ramp grooves formed in the interior of a coupling ring act against bayonet pins mounted on the electrical connector to effect coupling between the two components. A preloaded disc cone shape spring washer becomes effected during the coupling procedure to maintain a no-motion condition on the cable clamp used in high vibration or large shock forces areas. Additionally, a plurality of detent pins are automatically shifted into a holding position at the completion of the coupling action, thereby further contributing to the maintenance of the coupled condition between the cable clamp and electrical connector. Also, a grounding spring is centrally located on the cable clamp body which when coupled to an electrical connector makes interengageable contact thus providing low impedance and additional mechanical strengthening properties to the cable clamp.

5 Claims, 2 Drawing Sheets

BAYONET COUPLING, LOW IMPEDANCE, VIBRATION RESISTANT CABLE CLAMP

CROSS REFERENCE TO RELATED APPLICATIONS

This application is a continuation of application Ser. No. 08/503,762 filed on Jul. 13, 1995 (now abandoned) which is a continuation of application Ser. No. 08,048,702 filed on Apr. 15, 1993 and subsequently allowed and granted U.S. Pat. No. 5,458,501 on Oct. 17, 1995, which is a continuation-in-part of application Ser. No. 07/972,655 (now abandoned) filed on Nov. 6, 1992, which is a continuation-in-part of application Ser. No. 07/901,468 (now abandoned) filed on Jun. 19, 1992, which is a continuation-in-part of application Ser. No. 07/827,118 (now abandoned) filed on Jan. 28, 1992, which is a continuation-in-part of application Ser. No. 660,313 (now abandoned) filed on Feb. 22, 1991, which is a continuation-in-part of Ser. No. 516,403 (now abandoned) filed Apr. 30, 1990.

BACKGROUND OF THE INVENTION

This invention relates to cable clamps used on electrical connectors, and more particularly to a bayonet coupling cable clamp suitable for attachment to an electrical circular connector.

Past efforts for assembling a connector with cable clamp have included the following requirements:

1) Clean thread surfaces of cable clamp with cleaning solvent and wipe dry with absorbent wiper. Apply two drops of thread locking compound, each covering a minimum of two threads approximately 180 degrees apart, to the external threads of all parts prior to assembly of the connector and cable clamp. Allow compound to dry before assembly.
2) Tighten the cable clamp by hand, then tighten slightly beyond hand tight (maximum of ⅛ turn) with tools such as strap wrench, plug pliers, others.

—OR—

Torque and lockwired cable clamp per engineering drawing.

The above assembly process results in the following problems encountered by manufacturing:

1) Loose cable clamp due to coupling inconsistency caused by:
   operator
   tool usage
   incorrect torque value
2) Process is laborious and too operator dependent.
3) Torque tools and accessories are expensive.
4) High reword and maintenance cost.
5) Cable clamp assembly is not conducive to automation or robotic manipulators.

In contrast to the present connector which utilizes a rotating bayonet attachment, prior art patent literature has included:

U.S. Pat. No. 3,750,087 to Vetter which describes a preloaded connector which utilizes specially configured spring washers to maintain the connector halves in their coupled condition, but such connector uses a threaded cable clamp; and U.S. Pat. No. 3,478,302 to Chirumbolo; U.S. Pat. No. 2,984,811 to Henley, et al.; and U.S. Pat. No. 3,901,574 to Paullus, et al, which includes a rotating bayonet action for assembling the connector, however, not including cable clamps as hereinafter described.

SUMMARY OF THE INVENTION

Accordingly, one object of the present invention is to provide a preloaded connector cable clamp in which the relative motion between the cable clamp's components is essentially eliminated. In this regard, an aim of the invention is to provide a cable clamp in which there is a metal-to-metal bottoming of components when installed into an electrical connector to function as a wire bundle strain relief clamp and provide grounding path between cable clamp and connector. It will be appreciated that once the cable clamp is installed into an electrical connector, that they should not become inadvertently uncoupled, yet the cable clamp should allow ready uncoupling when it is desired to separate the cable clamp from the connector. Consequently, it is within the purview of the present invention to provide a cable clamp that will withstand a high degree of vibration, large shock forces, and appreciable temperature gradients or changes. Also, it is within the contemplation of the invention to provide a cable clamp that will be long lasting and exceedingly reliable during the entire assembly life.

Another object of the invention is to provide a cable clamp that requires relatively easy manual force to effect the coupling thereof. In this regard, the helical ramp grooves are configured so that most of the mating travel occurs before any appreciable amount of spring deflection occurs.

Yet another object of the invention is to provide a set of detent pins that automatically become effective in keeping the spring washers in place in maintaining the cable clamp in its coupled condition, the detent pins being shifted into their latching condition, near the end of the rotation of the coupling ring. More specifically, the load on the specially designed spring washers can be predetermined within desired limits, a retainer ring being positioned and secured in place to thereafter provide the correct amount of spring loading subsequent use of the cable clamp.

A further object of the present invention is to provide a preloaded cable clamp in which the coupling and uncoupling mechanism is effected without the use of tools. In this regard, it is within the purview of the invention to effect exceedingly reliable coupling less attributes such as torque threshold value, defective torque tools, deficient cable clamp assembly, and labor intensive safety sires (lockwiring).

Yet another object of the invention is to provide a cable clamp having a low impedance property achieved through the use of a grounding spring. In this regard, a ground path from the cable clamp to the electrical connector that exist when the two components are coupled together. The mode or state of the aircraft, whether static or dynamic, is of no consequence to the integrity and reliability on the electrical interface between cable clamp and electrical connector.

It is a further object of this invention to provide a cable clamp conductive to robotic and automated assembly into an electrical connector, as evidenced by the easy rotation on the coupling ring of the cable clamp to be used as the interface between cable clamp and electrical connector. More specifically, an aim of the invention is to provide a means by which the assembly occurs when the helical ramp grooves formed in the interior of a coupling ring act against a plurality of bayonet pins mounted on an electrical connector.

DESCRIPTION OF THE PREFERRED EMBODIMENT OF THE PRESENT INVENTION

The preferred embodiment of the present invention utilizes attachment to an electrical connector by a bayonet coupling method. Such preferred embodiment can replace the conventional threaded coupling arrangement that it is presently to used to assemble the cable clamp into an electrical connector. The coupling method described herein comprises a spring washer having a tapered cross section that is progressively defected, reaching a desired state of compression near the end of the coupling action. The requisite deflection occurs after a metal-to-metal bottoming on the cable clamp components with respect to an electrical connector has been achieved. A plurality of bayonet pins and correspondingly spaced helical ramp grooves arrangement are used in effecting the coupling between the cable clamp and electrical connector. Provision is also made for maintaining the action provided by the flexed spring washers, a plurality of detent pins being automatically shifted into an interfering relationship to they supplement the retentive actions of the spring washers.

DETAILED DESCRIPTION OF THE INVENTION

Figure 4:
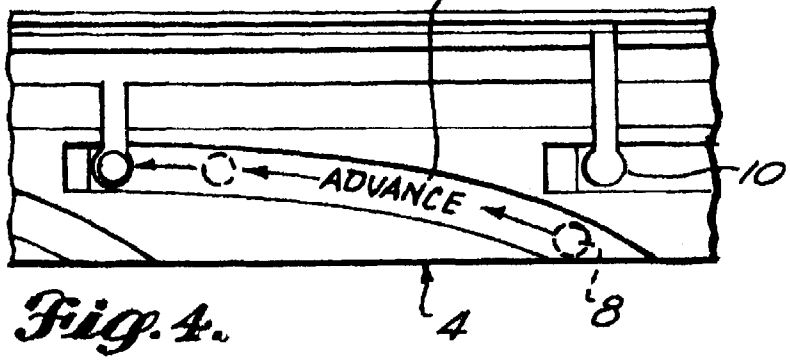
FIG. 4 is a plain view of the coupling ring 4 illustrating connector bayonet pins 8 traversing one of the helical ramp groove 9 on the cable clamp; the rightmost phantom outline of one of the bayonet pins 8 showing entering of the bayonet pins 8 into the helical ramp groove 9 and the other phantom position illustrating the point in the bayonet travel where the spring washers 11 starts to compress, and the solid or leftmost position of the bayonet pin 8 nested in the detent hole 10 on the coupling ring 4 is illustrating fully coupled condition of the cable clamp at which point the spring washers 11 have become sufficiently deflected to assure retentive coupled MMB 5 condition.

This invention relates to a bayonet coupling cable clamp to be used on electrical connectors as strain relief for wire bundle. As is conventional, cable clamp of this type include two basic components, such as clamp body 1 with locking accessory teeth 2 and saddle bars 3 and coupling ring 4 having a plurality of helical ramp grooves 9 formed in the interior of the coupling ring 4. FIG. 4 illustrates a full helical ramp groove 9 with one bayonet pin 8 extending into each helical ramp groove 9, and also depicted are detent holes 10.

Figure 5:
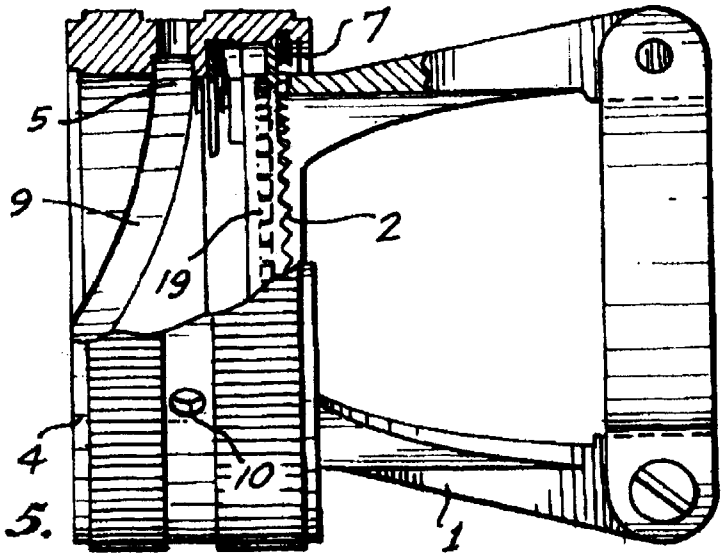
FIG. 5 is a cross-section isometric view of the cable clamp.
Figure 1:
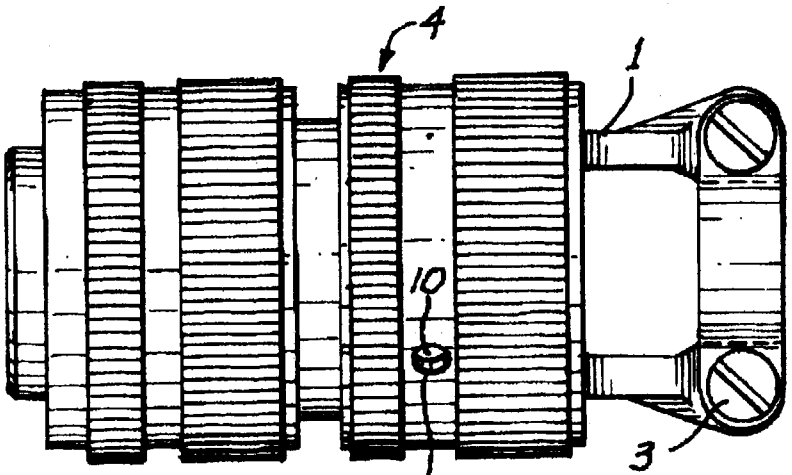
FIG. 1 is a side elevation of a cable clamp coupled to an electrical connector. Coupling means in accordance with the preferred embodiment bayonet method whereby metal-to-metal bottoming (MMB) arrangement 5 (see FIG. 3) is accomplished; bayonet pins 8 positioned inside coupling ring holes 10 ensures concurrence of MMB 5 condition.

The present embodiment Cable Clamp utilize a metal-to-metal bottoming (MMB) 5 coupling mechanism to withstand the unpressurized/high vibration areas of the airplane. MMB 5 exist when the helical ramp grooves 9 formed in the interior of the embodiment coupling ring 4 act against bayonet pins 8 mounted on an electrical connector to effect coupling between the two components. A specially tapered spring washer 11 becomes effective during the coupling procedure to maintain a no-motion condition of the two components after fully mated. To achieve maximum MMB 5, the spring washer 11 thickness, diameter, shape and material are optimized to establish spring washer 11 deformation force and working range or height. In this regard, it is to be observed that the spring washer 11 which is annular, has a thicker outside diameter and a thinner inside diameter. Furthermore, the inner periphery of the spring washer 11 is offset to the left or right (dependent on the washer 11 positioning during component assembly), as can be seen in FIG. 5, for maximum MMB 5.

Figure 2:
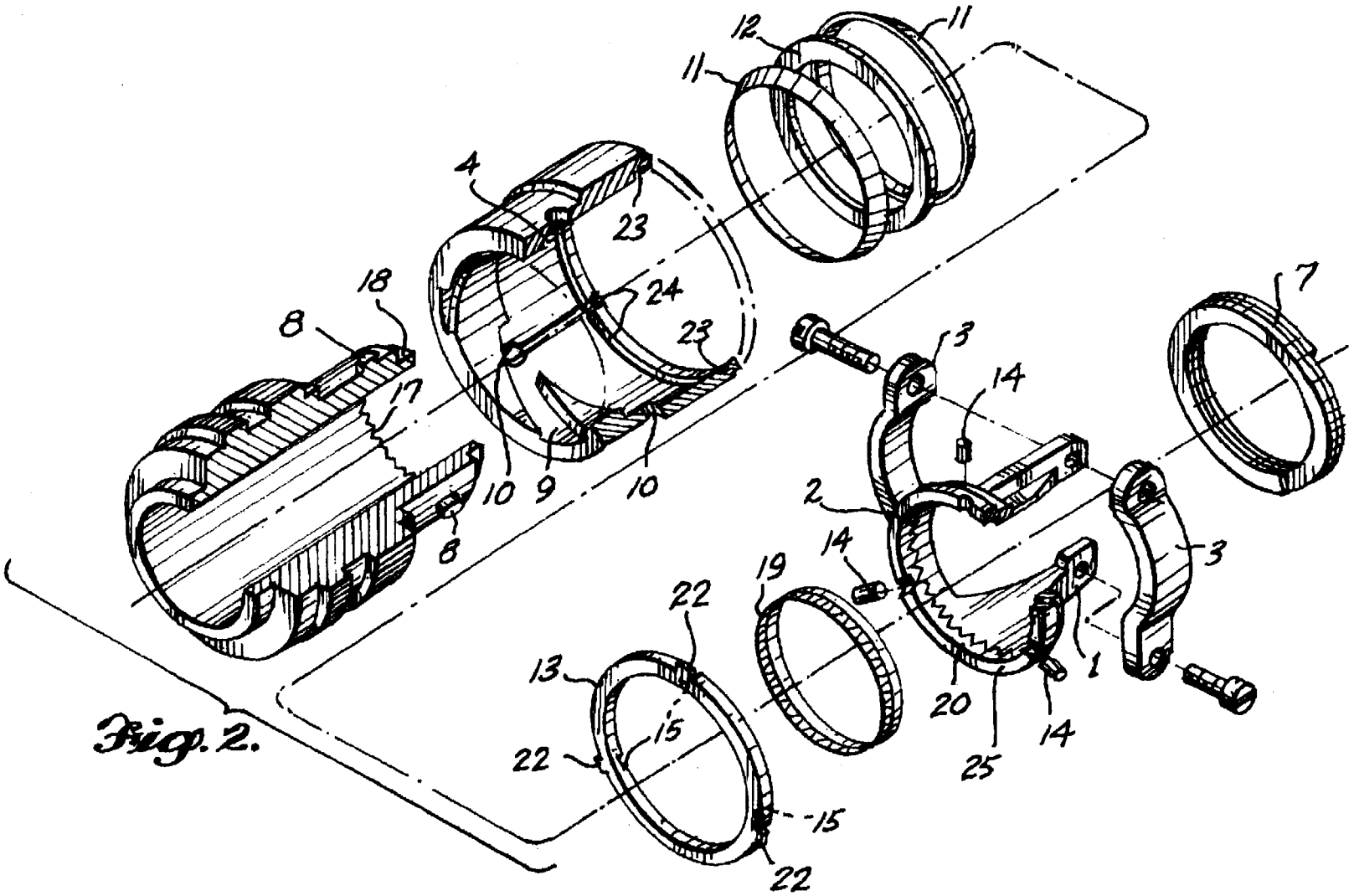
FIG. 2 is an exploded view of FIG. 1 which shows the connector bayonet pins 8 and components parts of the cable clamp, such as: coupling ring 4 with helical ramp grooves 9 formed in the interior of the coupling ring 4, MMB 5 accessories consisting of deflectable preloaded spring washers 11 positioned on each side of a flat washer 12, detent ring 13 with detent pockets 15 in a spaced relationship array with the detent pins 14, and grounding spring 19 centrally located in the clamp body 1. Also shown are saddle bars 3 used for wire bundle strain relief and a retaining ring 7 to connect clamp body 1 to coupling ring 4.

Describing now the components, as shown in FIG. 2, the right end of the coupling ring 4 is formed with grooves 24. Secured within the end of the coupling ring 4 by means of the grooves 24 are the two specially tapered spring washers 11 and a flat washer 12 positioned in between the two spring washers 11. Note the positioning of the two spring washer 11 to achieve maximum MMB 5 which can be seen clearly on FIGS. 3 and 5, whereby the inner spring washer 11 inner periphery is offset to the right while the outer spring washer 11 inner periphery is offset to the left. The detent ring 13 engages the outer spring washer 11 and it can be pointed out the detent ring 13 having an outer key 22 spaced uniformly and integrally formed thereon which projects radially into an equally sapced longitudinally directed keyways 23 formed in the interior of the coupling ring 4. Three equally spaced detent pins 14 are angularly housed around the face 25 of the clamp body 1. A plurality of detent pockets 15 corresponding to the number of detent pins 14 are angularly disposed around the detent ring 13. The function of the detent ring 13 is to co-act with the detent pins 14. Stated somewhat differently, the keyways 23 in the coupling ring 4 are selectively located so that the detent ring 13 can be angularly oriented so that the detent pockets 15 will be in alignment with the detent pins 14 each time the present invention cable clamp is coupled to an electrical connector. However, the detent pockets 15 are of smaller diameter than the detent pins 14 so that the detent pins 14 cannot be fully received therein. Coupling of the present invention cable clamp to an electrical connector will cause shifting of the detent pins 14 but is such as to only cause segmental portions thereof to be received in the detent pockets 5, as evidence during the later description of uncoupling the present invention cable clamp from an electrical connector.

Furthermore, as can be understood from FIG. 4, it is only when the bayonet pins 8 approach the closed ends of their respective helical ramp grooves 9 that the spring washers 11 are compressed or deflected from its preloaded state of deformation. Note that up to this point the bayonet pins 8, one is only appearing in the drawing, is represented as a dotted portion in FIG. 4, there is little resistance to the mating or coupling action. In other words, the camming performed by one side of each helical grooves simply acts against the bayonet pins 8 to pull the present invention cable clamp into its mating relationship with the electrical connector. By correlating the point of compression of the spring washers 11 with the approach of the bayonet pins 8 towards the end of their respective helical ramp grooves 9, the slope of the helical ramp grooves 9 is lessened to realize the maximum mechanical advantage. Stated somewhat differently, the spring washers 11 requires only a few thousandths (typically <0.0008 inch) of compression or flattening in order to become effective and this need only be obtained near the ends of the helical ramp grooves 9 where the slope is deliberately decreased, thereby minimizing the amounts of manual effort to rotate the coupling ring 4 under these terminating conditions.

Figure 3:
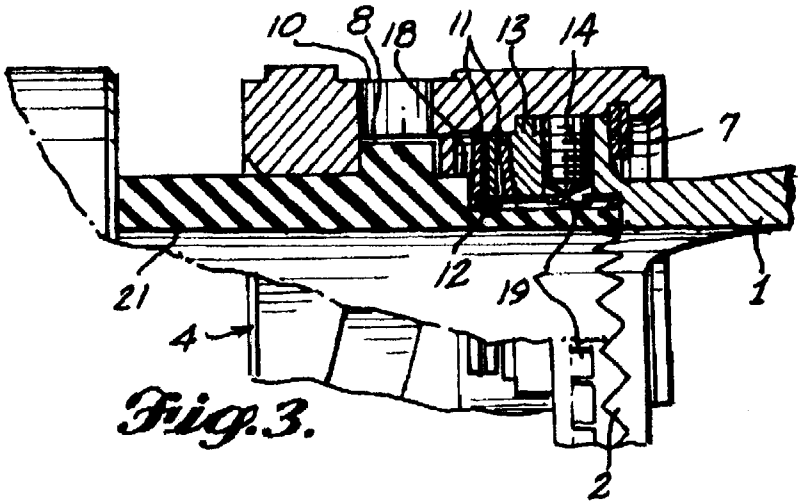
FIG. 3 is a sectional isometric view of FIG. 1 whereby the MMB 5 accessories are in the engage (fully coupled) position.

Recapitulating, the bayonet coupling of the present embodiment Cable clamp occurs when desired compression or deflection on the spring washers 11 are achieved under the influence of the detent pins 14 being retentively and partially received in the detent pockets 15 on the detent ring 13, as illustrated in FIG. 3. Also, engagement of the grounding spring 19 and accessory teeth 2 on the cable clamp and electrical connector further contribute to the maintenance of the coupled condition between the present invention cable clamp and electrical connector.

Additionally, a grounding spring 19 made of conductive material such as beryllium copper or nickel alloy is centrally positioned around the clamp body internal diameter 20. This grounding spring 19 provides interengageable contact between cable clamp and electrical connector shell 12, specifically, at connector end face 18 (can be described as the area on the electrical connector shell 12 between the first coupling thread start and valley of the locking accessory teeth 2) during coupling of the two components. Although the function thereof is not readily apparent at this stage of the description, it can be pointed out the grounding spring 19 is deflectable under load resulting to a resistive condition between present embodiment cable clamp and electrical connector. This attribute provides a direct or primary continuity path between present embodiment cable clamp and electrical connector shell resulting to a low impedance (<2.5 mOhms) property on the present embodiment cable clamp. Also ground spring 19 under load acts as a mechanical washer contributing significantly to the maintenance of the coupled condition between present embodiment cable clamp and electrical connector.

When uncoupling the Cable Clamp, a reverse rotation of the coupling ring 4 move the detent ring 13 so as to force the partially received detent pins 14 out of the detent pocket 15. However, until the desired uncoupling force is applied to the coupling ring 4, the detent pins 14, owing to the interfering relationship they have, further assist in the unwanted separation of the cable clamp and electrical connector. Once out of the detent pocket 15, the detent pins 14 simply roll against the face of the detent ring 13 in a reverse fashion from that in which they roll when the coupling is being affected. At this point, the spring washers 11 expand to their normal working height.

What is claimed is:

1. A cable clamp for an electrical connector having locking accessory teeth (2) and grounding spring (19) as interengageable contact means, coupling means for advancing said contact means to produce engagement;

a wavespring washer having uniformingly positioned surface projections that is progressively deflected, reaching a state of compression near said coupling means for providing movement;

said coupling means includes a rotatable coupling ring (4) having spaced helical ramp grooves (9) formed in the interior of said rotatable coupling ring (4);

said spaced helical ramp grooves (9) configured to receive bayonet pins (8) mounted on said electrical connector which are fixedly positioned in a spaced relationship with said spaced helical ramp grooves (9) during coupling of said cable clamp to said electrical connector;

said rotatable coupling ring (4) having detent including detent holes (10) at the end of said spaced helical ramp grooves (9) and in spaced relationship with said bayonet pins (8) on said electrical connector; and said detent holes (10) enabling said wavespring washer (11) to retain components in coupled relationship;

said detent means including said detent holes (10) shiftable in a retentive position; and, said grounding ring (19) joining said cable clamp and said electrical connector thereby providing said cable clamp with low impedance properties while minimizing vibration; and high vibration and large shock forces.

2. A cable clamp for an electrical connector having an accessory locking teeth (2) and a grounding ring (19) as interengageable contact means;

coupling means for providing movement advancing said contact means to produce engagement;

wavespring washer means interposed between a portion of said coupling means which said wavespring washer means having uniformly positioned surface projections that is progressively deflected, reaching a desired state of compression near the end of the said coupling means for providing movement;

said coupling means includes a rotatable coupling ring (4) having angularly spaced helical ramp grooves (9) formed in the interior of said ring (4); and, said helical ramp grooves (9) configured to provide maximum mechanical advantage when engaging or receiving bayonet pins (8) mounted on an electrical connector which are fixedly positioned in an spaced relationship with said grooves (9) during coupling of said cable clamp to said electrical connector;

said coupling ring (4) having detent holes (10) at the end of said helical ramp grooves (9) and in angularly spaced relationship with said bayonet pins (8) on said electrical connector; and, said detent holes (10) assisting and maintaining said wavespring washer (11) in the retention of said components in their coupled relationship;

said detent means includes said detent holes (10) shiftable in a retentive position;

said grounding ring (19) providing a direct and primary continuous joint between said cable clamp and electrical connector; and said cable clamp having low impedance property and high degree of vibration and large shock forces attributes.

3. In combination:

a cable clamp utilizing a bayonet coupling into an electrical connector including bayonet pins (8) mounted on said electrical connector;

a coupling ring (4) having helical ramp grooves (9) acting against said bayonet pins (8) for coupling to said electrical connector;

a plurality of detent pins (14) for maintaining a coupled condition between said cable clamp and said electrical connector; and, a grounding spring (19) disposed on said cable clamp coupled to said electrical connector for providing a low impedance between said cable clamp and said electrical connector.

4. A bayonet coupled vibration resistant cable clamp utilizing a metal-to-metal bottoming (MMB) mechanism for maintaining a no motion condition when coupled to an electrical connector wherein said (MMB) mechanism comprises:

a detent ring (13) having three equally spaced and angularly disposed detent pockets (15);

three detent pins (14);

two mainspring washers (11); and a flat washer (12) disposed between said two mainspring washers (11).

5. The invention according to claim 4 wherein said detent pockets (15) are of smaller diameter than said three detent pins (14).

* * * * *